United States Patent [19]

Damgaard

[11] 4,072,598

[45] Feb. 7, 1978

[54] ELECTROLYTIC POLISHING APPARATUS

[75] Inventor: Lavritz Gudmund Damgaard, Virum, Denmark

[73] Assignee: Struers K/S, Copenhagen K, Denmark

[21] Appl. No.: 740,970

[22] Filed: Nov. 11, 1976

[30] Foreign Application Priority Data

Nov. 12, 1975 Denmark ..... 5102/75

[51] Int. Cl.[2] ..... C25F 3/16; C25F 7/00; C25F 7/02

[52] U.S. Cl. ..... 204/274; 204/273; 204/129.6

[58] Field of Search ..... 204/129.6, 129.65, 239, 204/241, 274, 224 R, 273, 275

[56] References Cited

U.S. PATENT DOCUMENTS

| | | | |
|---|---|---|---|
| 2,110,487 | 3/1938 | Johnstone | 204/274 |
| 2,532,907 | 12/1950 | Hangosky | 204/129.6 |

FOREIGN PATENT DOCUMENTS

| | | | |
|---|---|---|---|
| 171,426 | 5/1952 | Denmark | 204/224 R |
| 1,131,092 | 10/1956 | France | 204/129.6 |

*Primary Examiner*—T. M. Tufariello
*Attorney, Agent, or Firm*—Watson, Cole, Grindle & Watson

[57] ABSTRACT

An electrolytic polishing apparatus, in which a polishing sample is pressed against an opening in a cover of a container, in which electrolyte is caused to rotate by means of a stirring magnet, said container having a central bottom opening and being placed in an outer bowl.

3 Claims, 3 Drawing Figures

ELECTROLYTIC POLISHING APPARATUS

BACKGROUND OF THE INVENTION

This invention relates to an electrolytic polishing apparatus having a magnetic stirrer. Such an apparatus is known from the French patent specification No. 1,131,092 and comprises a container, in which the magnetic stirrer is arranged and which has a cover with a polishing opening, against which a polishing sample can be pressed. In such a polishing apparatus the magnetic stirrer serves to set the electrolyte in rapidly rotating movement, whereby it is possible to obtain a so strong flow of the electrolyte along the surface of the polishing sample that the conditions necessary for the polishing effect (so-called polishing film) are not disturbed, while the gas bubbles liberated by the electrolysis are nevertheless removed. Thereby metal is dissolved from the surface of the sample in such a manner that a uniform and shiny surface is obtained, in which the structure of the metal can be observed without being distorted by the deformations inavoidable in the case of mechanical polishing.

The French patent specification shows two embodiments. In one embodiment the cover is placed sealingly on top of the container and, besides the polishing opening, is constructed with a middle opening. Since electrolyte may leak out between the polishing sample and the cover, the latter is so shaped that the leaking electrolyte can trickle down towards the middle opening. To obtain this, the cover is provided at least in the area of the polishing opening with a protruding edge, and this prevents use of the apparatus for polishing a sample extending beyond the edge of the cover. In the other embodiment, the cover is constructed in the form of a bell which rests on the bottom of the container and the outer diameter of which is somewhat smaller than the inner diameter of the container so that an annular space is formed which can receive leaking electrolyte. Owing to the stirring a pressure above that of the atmosphere is created in this annular space and the edge of the container must therefore extend upwardly beyond the upper face of the bell-shaped cover so that it is not possible in this case either to polish samples which have a size so as to extend beyond the edge of the container. A drawback of both embodiments is that it is difficult to replace the electrolyte by another one when the polishing of a great number of samples is to take place in a running operation. Moreover, it is to be mentioned that there is little possibility of dissipating the heat produced by the electrolytic polishing. To-day it is a desideratum to be able to polish surfaces of 10–20 $cm^2$, which requires currents of up to 20–25 Amp., whereby considerable quantities of heat are developed during the process. If there are no good possibilities of dissipating this heat, the capacity of the polishing apparatus is reduced.

SUMMARY OF THE INVENTION

It is an object of the invention to provide an electrolytic polishing apparatus in which the drawbacks mentioned above are reduced or eliminated. According to the invention, an electrolytic polishing apparatus of the general type referred to above comprises an upwardly open container having a bottom with a central opening, a cover for said container, said cover having a polishing opening against which a polishing sample can be pressed, a magnetic stirrer being provided in said container, said container being placed in an outer bowl for receiving electrolyte escaping at the top of said container during the polishing operation. In an apparatus constructed in this manner, the pressure in the annular space between the container wall and the wall of the outer bowl will be lower than that prevailing at the inner wall of the container, and the liquid level in the outer bowl will therefore be lower than that in the container, the latter level being determined by the cover. The upper edge of the outer bowl can therefore be situated at a lower level than the upper face of the cover so that it becomes possible to polish surface portions of objects having a size such as to extend beyond the circumference of the cover. Replacement of electrolyte can be undertaken in a very simple manner, viz. by lifting the container up from the outer bowl and replacing the outer bowl by another one containing another electrolyte. In this manner the electrolyte in the outer bowl can simply be stowed away for renewed use, and since the electrolyte flows out of the bottom opening of the container when the latter is lifted, there will be only insignificant residues of electrolyte left in the container, so that when replacing electrolyte practically no mixing of different electrolytes will take place. Owing to the suction of electrolyte through the bottom opening of the container in replacement of the electrolyte leaking out from the container during the polishing operation there will be produced a more or less pronounced circulation of electrolyte through the annular space between the container and the outer bowl, whereby improved possibilities of cooling are obtained. Seeing that in the apparatus according to the invention there is no need for keeping the electrolyte escaping during the polishing operation on a minimum, the cover may advantageously rest loosely on the upper edge of the container. Thereby the leakage of electrolyte is increased, which tends to improve the cooling, and moreover it becomes easy to replace the cover by another one having a polishing opening of a different shape, or a plurality of polishing openings.

With particular advantage controlled flow paths may be established between the upper edge of the container and the cover and between the bottoms of the container and the outer bowl. E.g. groove-like recesses may be provided in the underface of the cover or the upper edge of the container, and the bottom of the container may be means of projections be supported at a distance from the bottom of the outer bowl. By these measures, it is possible to obtain a desired circulation of electrolyte through the annular space between the container and the outer bowl, whereby the possibilities of cooling may be further improved.

These cooling possibilities may be utilized by providing the apparatus with cooling means for the circulating electrolyte. The cooling means may be in the form of a cooling jacket with water circulation. They may be arranged on the outer bowl, but with particular advantage the cooling means may be arranged on the outer side of the container. Thereby the advantage is obtained that they have a cooling effect both in the annular space between the container and the outer bowl and in the interior of the container. Moreover, cooling means provided on the outer side of the container will displace a substantial amount of electrolyte when the container is lowered into the outer bowl. It is therefore possible to have a relatively low liquid level in the outer bowl so that this may be removed and replaced by another one containing another electrolyte without any danger of spilling. When the container with the cooling means provided on its outer side is lowered into the outer bowl, the liquid level increases so that in spite of the low liquid level in the outer bowl when not in use, a relatively high liquid level is obtained when the container is lowered into the bowl, which is desirable in order that the annular surface swept by the electrolyte during its rotation should be as large as possible so that the polishing opening or openings can be made large.

DESCRIPTION OF THE PREFERRED EMBODIMENTS

Figure 1:
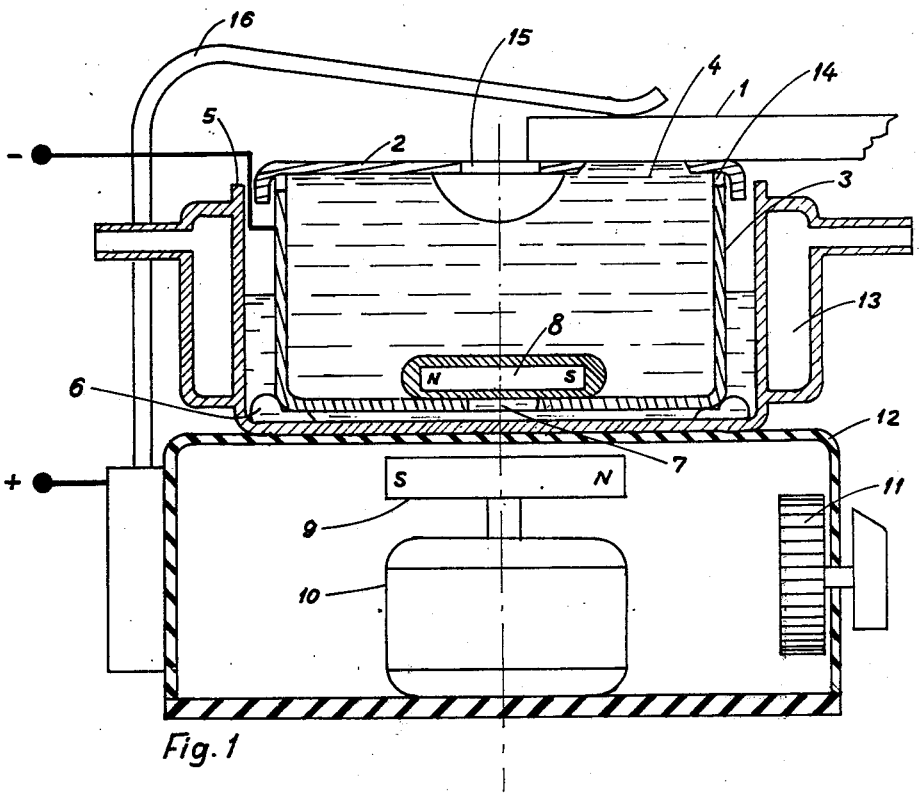
FIG. 1 shows diagrammatically a vertical section through a polishing apparatus according to one embodiment of the invention.

In the embodiment of FIG. 1, a metal sample 1 to be polished is placed on a plate 2 which is made from insulating material and forms a loose cover of a metal container 3. The plate 2 has an opening 4, referred to as the polishing opening, which defines the desired polishing area. The container is placed within an outer bowl 5 and rests on a number of projections 6 so that there is a small distance between the bottoms of the container and the bowl. In the middle of the bottom of the container 3 there is provided an opening 7. A stirring magnet 8 embedded in a plastics material lies in the container 3 above the middle opening and can be rotated in known manner by another magnet 9 which is driven by an electric motor 10, the number of revolutions of which can be controlled by means of a rheostat 11. The electric motor 10 with the magnet 9 are enclosed in a box 12 on the upper face of which the outer bowl 5 rests loosely.

The bowl 5 may be provided on its outer side with a cooling jacket 13 through which cooling water is circulated. A quantity of electrolyte is filled into the bowl 5 to make the electrolyte stand at a level in the container 3 such that upon rotation of the stirring magnet 8 at a suitable speed the liquid rises and covers the polishing opening 4.

The edge of the container 3 is provided with cuts or grooves 14 permitting electrolyte from the container to flow out into the bowl 5, thereby flowing along the cooling jacket or just being cooled by the surrounding air. A flow passage between the plate 2 and the edge of the container 3 could of course also be obtained by providing small projections on the underface of the plate.

Since the annular space between the container and the outer bowl communicates with a rotating quantity of fluid at its middle, where the pressure is low, viz. through the opening 7, the liquid level in the annular space will fall until a state of equilibrium is obtained. Electrolyte penetrating between the sample and the plate 2 will join the electrolyte escaping between the plate and the upper edge of the container and will flow into the annular space and from there into the container through the opening 7.

Since the liquid level in the annular space is lower than that in the container, the latter being determined by the plate 2, the edge of the bowl 5 may be situated at a lower level than the upper face of the plate 2 and it is therefore possible to apply large metal samples extending beyond the contour of the apparatus.

The gases liberated by the electrolysis escape through a hole 15 of the plate 2. This hole also permits the liquid level in the inner container to adjust itself freely. In the electrolytic process, the metal sample forms one pole, electrical connection being obtained by means of a spring clip 16, and the container 3 forms the other pole. If a plurality of spring clips are provided in analogy to 16, the plate 2 may have a plurality of polishing openings so that a plurality of samples may be polished simultaneously.

By the described arrangement the advantage is obtained that it is very easy to replace the electrolyte, which is frequently desirable because different electrolytes must be used for different metals and that in replacing the electrolyte very little of one electrolyte is carried over to the other.

This is obtained by lifting the container out of the outer bowl 5. The electrolyte flows out of the opening 7, and the outer bowl 5 may be removed and replaced by another one containing the desired electrolyte. Thus, by the arrangement according to the invention the following advantages are obtained:

1. It is possible to polish large samples extending beyond the contour of the apparatus.
2. Escaping electrolyte is conducted back to the outer bowl.
3. The gases developed during the electrolysis are permitted to escape to the surrounding atmosphere.
4. There will be excellent possibilities of cooling either by the surrounding air or by means of a cooling jacket.
5. Since the plate 2 is a loose cover it can easily be replaced by other plates having polishing openings of different sizes and shapes in accordance with the samples to be polished.

Figure 2:
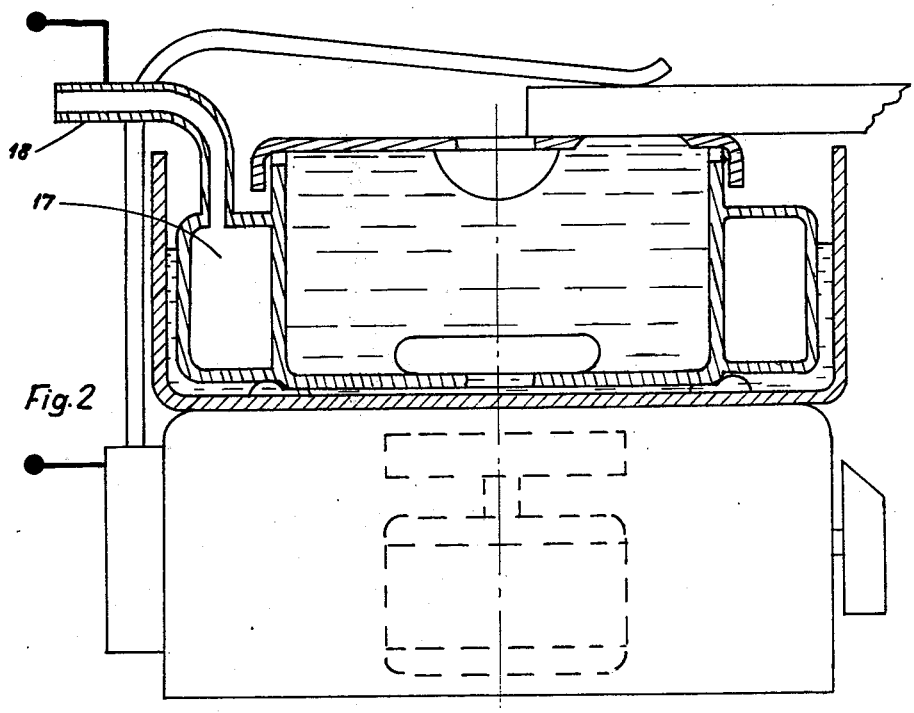
FIG. 2 shows a corresponding illustration of a second embodiment of the invention.

In the embodiment shown in FIG. 2, the cooling jacket 13 has been replaced by a cooling jacket 17 mounted on the container 3. This is supplied with cooling water through two pipes 18 also serving as an electrical connection. Only one of the pipes is shown. Since these pipes can be placed side by side they do not reduce the access to the upper face of the plate 2 substantially more than the spring clip 16 anyway does.

Hereby the following advantages are obtained: The outer bowl 5 becomes very simple and cheap and has no connection to the cooling water pipes. It is therefore well suited as an exchangeable electrolyte container. Thus, one may have an array of containers with different electrolytes at one's disposal and in each individual case select the one suitable for the metal sample to be polished. Another advantage is that the container with the cooling jacket mounted thereon displaces a large volume. When the inner container has been lifted up, the liquid level in the outer bowl is therefore much lower than during the polishing, and the outer bowl can therefore easily be moved without spilling. A still further advantage is that the cooling jacket is swept by electrolyte on both sides and therefore has an improved cooling effect.

Figure 3:
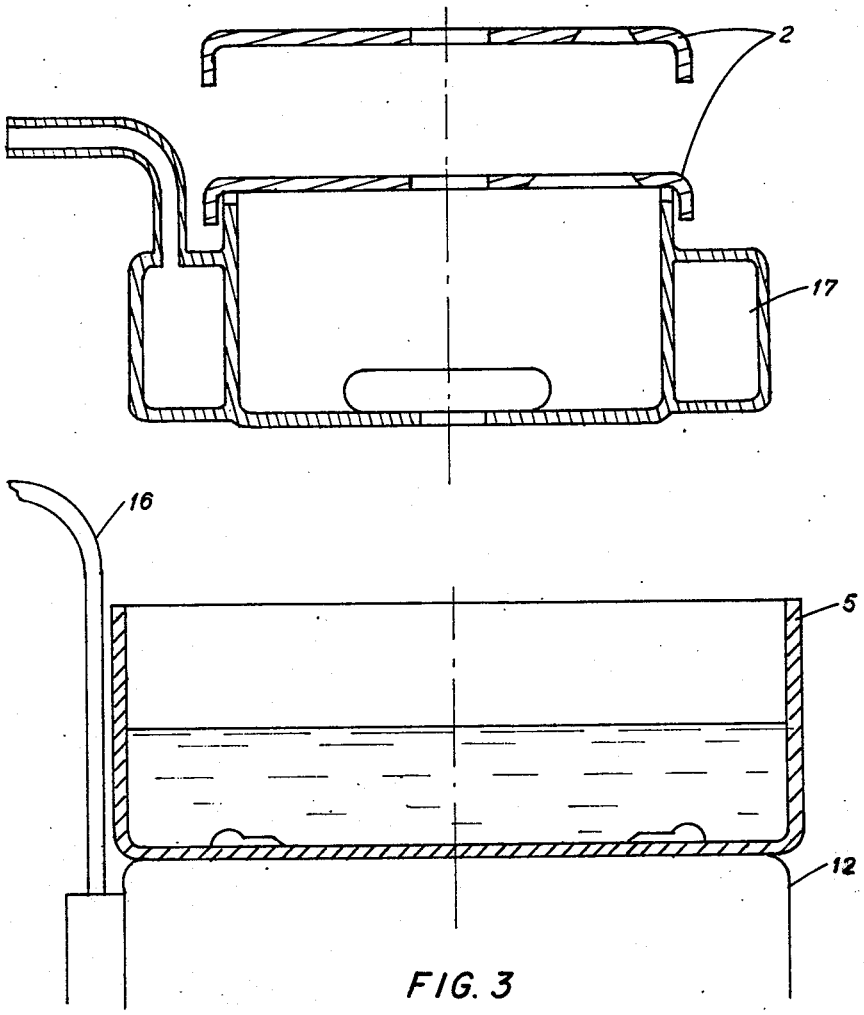
FIG. 3 shows the embodiment of FIG. 2 with the container lifted up from the outer bowl.

FIG. 3 shows the container with the cooling jacket mounted thereon as lifted out of the outer bowl, whereby the liquid level has fallen. The figure further illustrates how the plate 2 has been removed and replaced by another plate having a different form of polishing opening.

I claim:

1. Electrolytic polishing apparatus comprising: an upwardly open container for receiving a quantity of electrolyte for use in the electrolytic polishing operation, said container having a bottom with a central opening, a cover for said container, said cover having a polishing opening against which a polishing sample can be pressed, a magnetic stirrer being provided in said container above said central opening, said stirrer being rotatable by magnetic means outside said container to set said quantity of electrolyte in rapidly rotating movement to create a flow of electrolyte along the surface of a sample pressed against said polishing opening and at the same time to produce a pressure gradient from said central opening towards the inner wall of said container, said container being placed in an outer bowl for receiving electrolyte escaping at the top of said container during the polishing operation, the upper face of said cover being located at a higher level than the upper edge of said outer bowl.

2. Electrolytic polishing apparatus as in claim 1, in which controlled flow paths are provided between the upper edge of said container and said cover, and between the bottoms of said container and said outer bowl.

3. Electrolytic polishing apparatus as in claim 1, further comprising cooling means on the outer side wall of said container for circulating electrolyte.

* * * * *